United States Patent [19]

Vanhumbeeck et al.

[11] 4,286,965

[45] Sep. 1, 1981

[54] CONTROL APPARATUS FOR AUTOMATICALLY MAINTAINING BATH COMPONENT CONCENTRATION IN AN ELECTROLESS COPPER PLATING BATH

[75] Inventors: Jacky Vanhumbeeck, Brugge; Hubert De Steur, Drongen; Guido Heyneman, Knokke; Chris Vandenbossche, Zwijnaarde, all of Belgium

[73] Assignee: Siemens Aktiengesellschaft, Berlin & Munich, Fed. Rep. of Germany

[21] Appl. No.: 125,374

[22] Filed: Feb. 28, 1980

[30] Foreign Application Priority Data

Mar. 21, 1979 [DE] Fed. Rep. of Germany ..... 2911073

[51] Int. Cl.[3] ..... G01N 31/16; B05D 3/12

[52] U.S. Cl. ..... 23/230 A; 118/689; 422/62; 427/443.1

[58] Field of Search ..... 23/230 A; 422/62; 106/1, 23; 118/7; 427/437, 443.1; 364/500

[56] References Cited

U.S. PATENT DOCUMENTS 4,096,301 6/1978 Slominski et al. ..... 23/230 A

FOREIGN PATENT DOCUMENTS 2751104 5/1978 Fed. Rep. of Germany .

*Primary Examiner*—Ronald Serwin

*Attorney, Agent, or Firm*—Hill, Van Santen, Steadman, Chiara & Simpson

[57] ABSTRACT

A control apparatus for automatically controlling at least the concentration of copper-ions, hydroxyl-ions and formaldehyde-ions in an electroless copper plating bath and independently analyzing, displaying and replenishing the concentration of each such ions whereby a sample for each of the ions is discontinuously removed from the plating bath and diluted with a specific amount of water and, independently of one another, the copper-ion concentration is colorimetrically analyzed, displayed and replenished as needed, the hydroxyl-ion concentration is potentiometrically analyzed, displayed and replenished as needed and the formaldehyde-ion concentration is amperometrically analyzed, displayed and replenished as needed.

13 Claims, 3 Drawing Figures

CONTROL APPARATUS FOR AUTOMATICALLY MAINTAINING BATH COMPONENT CONCENTRATION IN AN ELECTROLESS COPPER PLATING BATH

BACKGROUND OF THE INVENTION

1. Field of the Invention

The invention relates to an electroless plating bath control apparatus and somewhat more particularly to such a control apparatus for electroless plating of copper wherein at least formaldehyde, sodium hydroxide and a copper salt comprise the main bath conponents and their respective concentration is controllable to relatively constant values, with the copper-ion concentration being colorimetrically defined and the formaldehyde-ion and hydroxyl-ion concentrations being titrimetrically defined.

2. Prior Art

In electroless plating or precipitation of, for example, copper from a suitable chemical copper bath, the concentration of main components of such bath must be analyzed and controlled or replenished as needed so that the precipitation conditions remain substantially constant and substantially faultless copper layers are attained.

A control apparatus for use with an electroless copper plating bath is described in U.S. Pat. No. 4,096,301. In this apparatus, a bath sample is continuously removed from the copper plating bath. A standardized acid of a select concentration and amount is likewise continuously added to the bath sample so that a final acid value, defined in terms of plating potential, is achieved. After appropriate mixing, the acidified bath sample passes through a pH analyzing station wherein the actual pH value is measured and compared with a predefined rated value. Given a deviation from such rated value, sodium hydroxide solution is added to the copper plating bath is accordance with such deviation. Thereafter, the so-processed bath sample is passed through a colorimetric station wherein the copper ion concentration is analyzed or monitored and, given a deviation from a rated value, an appropriate amount of fresh copper salt solution is added to th copper bath so as to replenish the concentration of copper ion therein in an amount corresponding to the observed deviation. After passing through the colorimetric station, sodium sulfide is constantly added to the resultant bath sample and, after appropriate mixing, this buffered bath sample is passed to a further pH analyzing station where the pH value of the bath sample is again determined and the difference between the now-measured value and the previously measured pH value is determined. This difference in pH value is utilized as an indirect measure of the formaldehyde concentration in the plating bath. Again, given a deviation from a rated value, an appropriate amount of formaldehyde is added to the plating bath.

A somewhat similar control system for use with an electroless copper plating bath is described in German Offenlegungsschrift 27 51 104. In this system, a bath sample is likewise continuously removed from a chemical copper bath and introduced into a chamber in which a "precipitation" electrode is positioned. Adjacent to this chamber, a second chamber is positioned with a "comparison" electrode therein, which together with the precipitation electrode functions to determine a so-called "mixing potential". After the determination of such mixing potential, the resultant bath sample is passed, via a heat-exchanger means, to a pH analyzing station and a colorimetric station. The individual bath components are then replenished as needed as a function of the mixing potential.

In the above described known plating bath control apparatuses, the concentration of the individual conmponents are not positively or absolutely determined or displayed and instead such concentrations are only determined relative to predetermined rated values. The absolute concentration of the individual components thus is never known. Further, the determination of pH value is also problematical since this value cannot be held constant over extended time periods due to electrode drift. Accordingly, an occasional re-calibration is unavoidably necessary.

SUMMARY OF THE INVENTION

The invention provides a control apparatus for use in an electroless copper plating bath whereby the concentrations of at least the main components of such a bath can be precisely analyzed, displayed and controlled.

In accordance with the principles of the invention, a bath control apparatus is characterized by an arrangement wherein a bath sample is discontinuously taken for each of the main components of the bath and diluted with a specific amount of water and, independently of one another, the copper-ion concentration is determined colorimetrically, the sodium hydroxide concentration is determined via potentiometric titration and the formaldehyde concentration is determined via amperometric titration.

Absolute values of ion concentrations are obtained via a precise analysis of the individual components in the plating bath so that the concentration thereof can be precisely controlled. In this manner, not only is an optimum utilization of the plating bath achieved, but in addition, a substantially uniform copper layer is always attained.

In the practice of preferred embodiments of the invention, the copper-ion concentration is identified by means of a two-beam intermitting-light colorimeter because such an analyzer requires only a single photo-element for light measurement and a measuring beam and a comparison beam can be altneratively directed onto such a single photo-element. The photo currents emitted by the photo-element thus correspond to the light intensities transmitted by the measuring or comparison cell. The logarithm of the ratio of the two output signals is a measure of the copper-ion concentration and can be converted into an analog voltage via a special electronic circuit. The deviation of the copper concentration from a rated value is identified in terms of soft-ware and defines, for example, the open or replenishment time of a metered addition unit adding supplementary copper solution to a copper plating bath.

In preferred embodiments of the invention, the potentiometric titration of the sodium hydroxide solution is calculated from the three greatest potential stages, given a constant addition of a titrating agent via an approximation method known per se. Preferably, the addition of a titrating agent occurs with the assistance of a motorized piston burette (a preferred form of which is disclosed and claimed in copending U.S. application Ser. No. 124,139, filed Feb. 25, 1980, which is incorporated herein by reference) in constant volume units by means of a corresponding step-wise control of the burette motor. Preferably, a constant resting time is provided after each individual addition of the titrating agent so as to stabilize the solution before deriving a signal therefrom. In this manner, a very precise and exact determination of the sodium hydroxide concentration is achieved.

In preferred embodiments of the invention, the amperometric titration of formaldehyde concentration is determined with a titrating agent comprised of hydroxylammonium hydrochloride, ($NH_2OH.HCl$), along with a gold work electrode operating with a polarization voltage of preferably about +50 mV relative to a silver/silver chloride reference electrode functioning with a platinum counter-electrode, with the current between such work electrode and counter-electrode comprising a signal corresponding to the $CH_2OH$ concentration. The end point of such titration is preferably determined by means of an intersecting point of two straight lines, one of which passes through the minimum of the titration curve and extends parallel to the abscissa axes and the other of which is determined by a plurality of measured points along the quasi-linear area of the subsequently rising portion of the titration curve.

DESCRIPTION OF THE PREFERRED EMBODIMENTS

Figure 1:
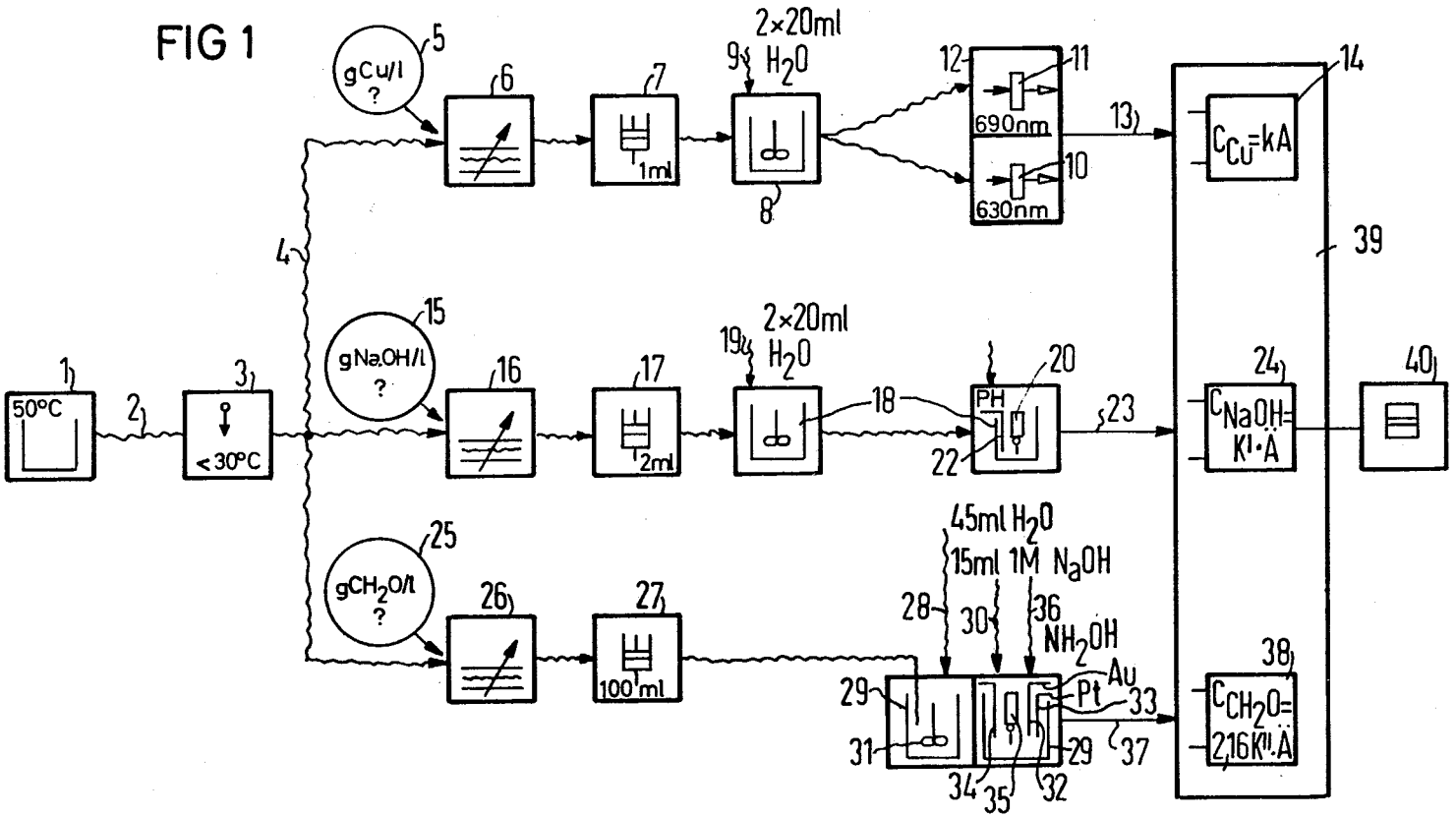
FIG. 1 is a somewhat schematic illustration of the chemical process sequence utilized in the practice of the invention.

FIG. 1 schematically illustrates a chemical flow process useful in the practice of the invention. An electroless copper plating bath 1 is provided with a predetermined specific composition wherein copper (or copper-ions), sodium hydroxide (or hydroxyl-ions) and formaldehyde (or formaldehyde-ions) are present as main components. The concentration of such main components must be regulated so as to be relatively constant over the operating life of the bath. Such a chemical copper bath operates, for example, at a temperature above about 50° C., as schematically indicated. A conduit 2 is provided for removing a given amount of the fluid contents from the chemical copper bath 1 for sample analysis. The removed portion of the bath is passed through a cooling device 3 wherein, as indicated schematically, the bath portion is cooled down to at least about 30° C. A multi-branched conduit 4 is provided in communication with device 3 and at least three independent analyzing stations 5, 15 and 25 respectively.

The upper portion of FIG. 1 illustrates the process sequence for determining copper-ion concentration by colorimetry. The quantitative value sought is the concentration of copper in grams per liter, as schematically indicated at station 5. Suitable means are provided, as schematically indicated at 6 and 7, for taking a discontinuous sample in a precise amount (i.e., equal to about 1 ml). This 1 ml sample is passed to a mixing container 8 and there twice diluted with 20 mls of water, as indicated by arrow 9. Two measurements cells 10 and 11 of a colorimeter 12 are filled with the diluted sample from container 8. The measurement cell 11 has a thickness of about 10 mm and the measurement cell 10 has a thickness of about 20 mm. The light measurement in the colorimeter occurs at 690 nm. In preferred embodiments, an intermittent-light colorimeter is utilized because such a device requires only a single photo-element for light measurement and the measuring and comparison beams can alternatingly strike such single photo-element. A signal proportional to the light intensity is transmitted from colorimeter 12 via line 13 to an appropriate evaluation circuit 14 wherein the copper concentration, $C_{Cu}$, is calculated from the product k·A, wherein k is a calibration factor and A is the derived signal proportional to the copper concentration.

The central portion of FIG. 1 illustrates the process sequence for determining hydroxyl-ion concentration via potentiometric titration. Here, the quantitative value sought is the concentration of sdium hydroxide in grams per liter, as schematically indicated at station 15. Again, a discontinuous sample removal occurs via means 16 and means 17 from conduit 4. Preferably, a sample amount of about 2 ml is withdrawn and passed to a mixing container 18 where the sample is twice diluted with 20 mls of water to obtain a diluted sample, as indicated by arrow 19. Titration of the diluted sample occurs with diluted hydrochloric acid in the same container 18 or in a duplicate container, as shown. A motorized piston burette 20 adds constant volume units, $\Delta V$, equal to about 0.2 mls of a 0.1 M hydrochloric acid to the diluted sample via an appropriate step-wise control of motorized piston burette 20, as schematically indicated by line 21. A pH electrode 22 is positioned in contact with the titration solution. After each unit addition of the titrating agent, an "idle" time, $\Delta t$, ranging between 1 to 5 seconds is provided to stabilize titrated solution. Such idle time can be shortened at the beginning of the titration process and correspondingly lengthened upon approach of the titration end point. A signal proportional to the end point is transmitted from container 18 to an appropriate evaluation circuit 24, wherein the sodium hydroxide concentration, $C_{NaOH}$, is determined from the product K'·Ä wherein K' is a calibration factor and Ä is the calculated volume at the titration end point.

The lower portion of FIG. 1 illustrates the process sequence for determining formaldehyde-ion concentration via amperometric titration. Here, the quantitative value sought is the concentration of formaldehyde in grams per liter, as schematically indicated at station 25. Again, a discontinuous sample removal occurs via means 26 and 27. The so-isolated sample amount (about 100 ml) is passed to a titration container 29 via a line 28. Before actual titration occurs, 15 mls of 1 M NaOH diluted with 45 mls of $H_2O$ are added to container 29, as schemtically indicated by arrow 30. A stirring means 31 is activated to intimately intermix the solutions within container 29. Positioned within the titration container 29 are, respectively, a gold electrode 32, functioning as a work electrode; a platinum electrode 33, functioning as a counter-electrode; and a silver/silver chloride electrode 34 functioning as a reference electrode. The work electrode 32 is polarized with a constant voltage, $U_{pol}$ of 0 through +200 mV relative to reference electrode 34. A titration agent, $NH_2OH.HCl$ is controllably added to the container 29 via line 26 and a motorized piston burette 35.

With the assitance of an appropriate circuit (not shown) the voltage between work electrode 32 and counter-electrode 33 is controlled in such a manner that the voltage of the work electrode 32 always remains constant relative to that of reference electrode 34. With the utilization of a silver/silver chloride electrode as the reference electrode, it is advantageous to select a polarization voltage equal to about +50 mV. The current thereby flowing between counter-electrode 33 and work electrode 32 is measured and produces a specific titration curve as a function of the added amount of titration agent. On the basis of such a titration curve, illustrated at FIG. 3, the end point of the titration process can be determined by per se known methods. Preferably, a method is selected so that the titration end point can be completely automatically determined.

The utilization of a gold electrode as the work electrode 32 is preferred because no copper can deposit during the titration process because the gold electrode always has a positive potential. In an exemplary embodiment of the invention, it has been determined that precise results can be attained by utilizing a concentration of titrating agent, $NH_2OH.HCl$, equal to about 0.5 g/l. The output signals of the amperometric titration are transmitted via line 37 to an appropriate evaluation circuit 38 wherein the end point of the titration is calculated via a computer means and the formaldehyde concentration, $C_{CH_2OH}$, calculated in accordance with the mathematical relation:

$$C_{CH_2OH}=2.16\cdot K''\cdot Ä$$

wherein K'' is a calibration factor and Ä is the calculated volume at the titration end point.

Figure 3:
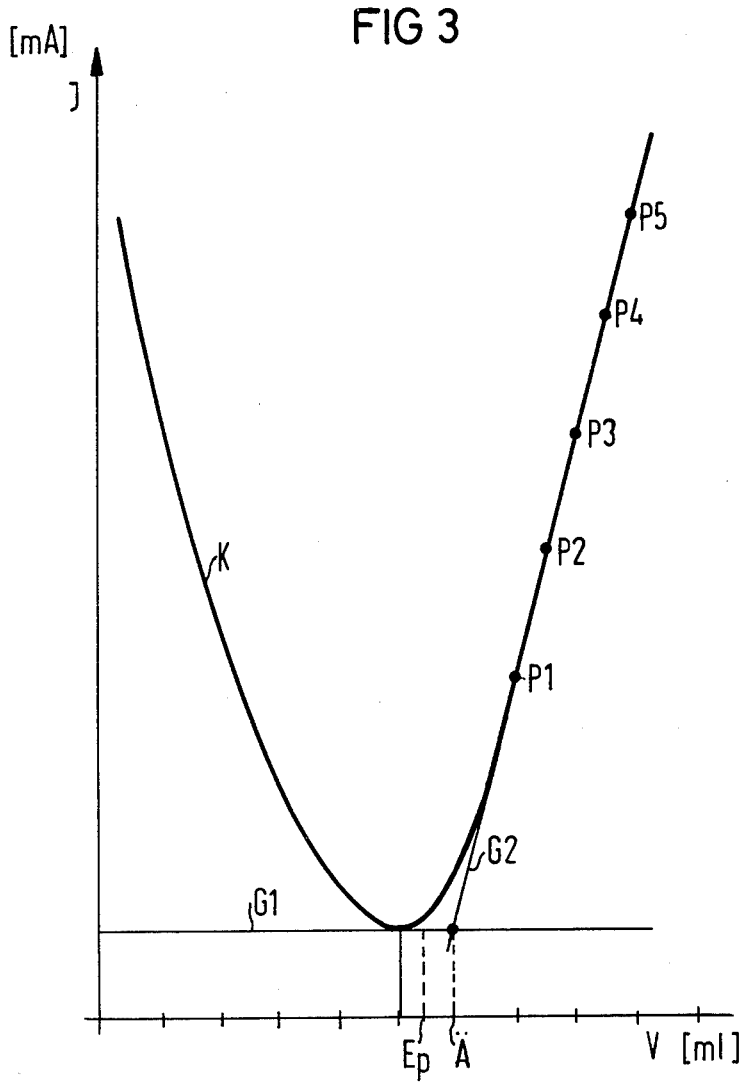
FIG. 3 is a titration curve of an amperometric titration useful in the practice of the invention.

The calculation of a titration end point will be described in greater detail in conjunction with FIG. 3. FIG. 3 shows a typical path of a titration curve, K, during an amperometric titration of formaldehyde utilizing the parameters set forth above. In the curve, the current, I [mA] is indicated as a function of the amount V [ml] of a continously added titration agent, $NH_2OH.HCl$.

Preferably, the end point, $E_p$, of the amperometric titration is determined by a point of intersection, Ä of two straight lines, $G_1$ and $G_2$, one of which ($G_1$) extends parallel to the abscissa axis and passes through the minimum of the titration curve and the other ($G_2$) is defined by a plurality of measured points $P_1 \ldots P_5$ in the quasi-linear area of the rising portion of the curve following the minimum point thereof.

Thus, for determining one of the straight lines only the minimum of the titration curve must be defined. Five measured points $P_1 \ldots P_5$ in a linear area are employed to define the other straight line. The calculation of this striaght line can occur with a regression method known per se. The calculation itself occurs with the assistance of a computer means. During the development of the invention it was proven that the deviation between the actual and calculated $Ä-E_p$ is substantially constant and, as such a constant value, can be taken into consideration by being subtracted from a calculated value.

In this manner the concentration of copper, sodium hydroxide and formaldehyde are thus determined completely indpendently from one another. The individual control operations for the elements in each of the analyzing stations as well as the processing of the measured values are carried out with the assistance of a control circuit 39 contained in a microprocessor.

The concentration of the main bath components, copper, sodium hydroxide and formaldehyde are thus automatically analyzed and the results are positively logged or displayed at a means 40.

By comparing the measured values obtain in this manner against an adjustable rated value, a signal which is time-proportional to the deviation is formed for each component. Such signals are employed to control appropriate metering units for replenishment of the bath with the appropriate components thereof. In addition, the bath temperature can also be measured and logged.

Figure 2:
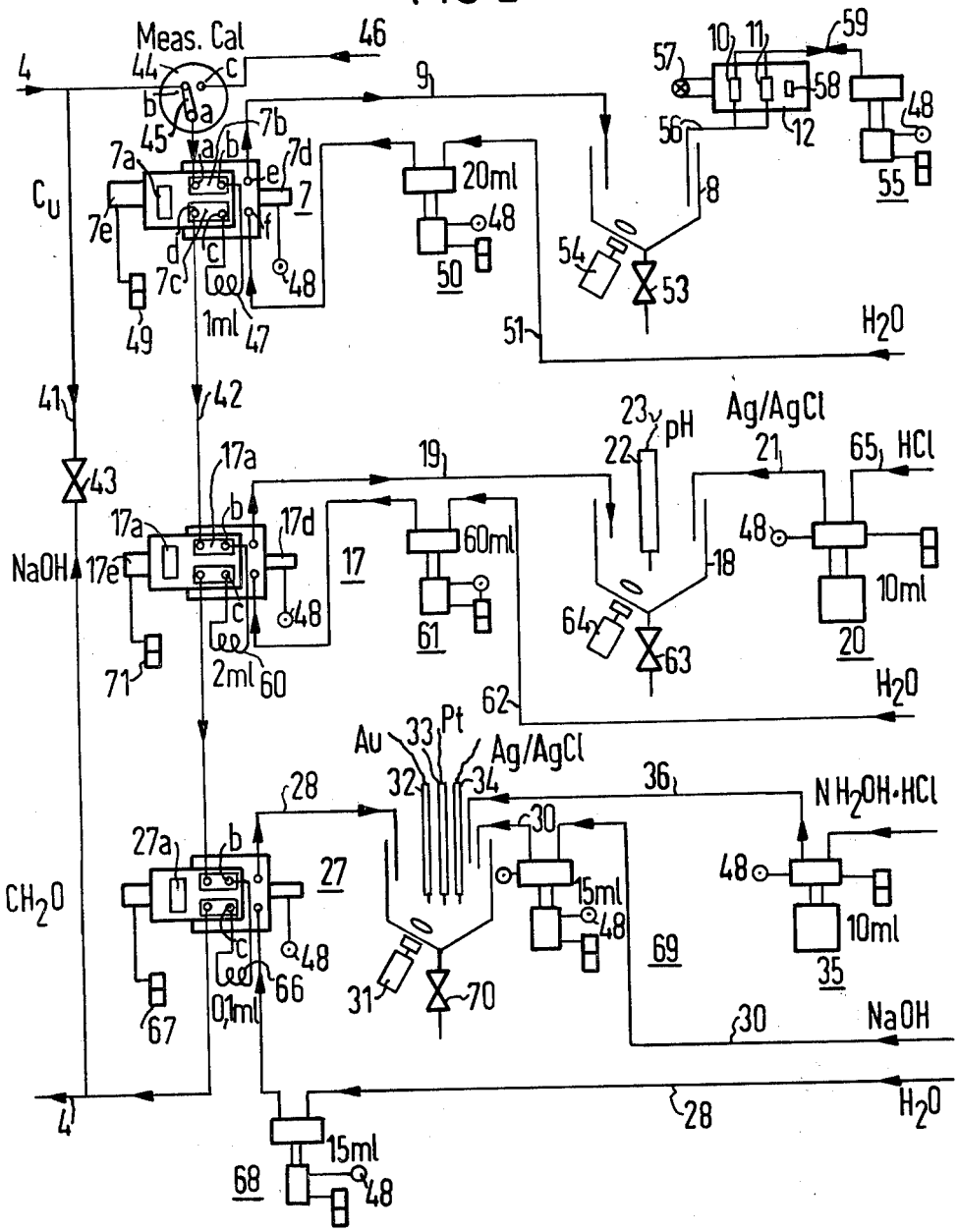
FIG. 2 is a somewhat schematic view of the mechanical elements of a bath control apparatus in the basic flow diagram shown at FIG. 1.

Referring now to FIG. 2 which schematically illustrates the mechanical elements of the bath control apparatus in a basic wiring diagram whereby the various elements with like effects are referenced with the same reference numeral as in FIG. 1.

A hydraulic recirculating flow path is provided between sample-removal conduit 4 and sample-transport conduit 42 via intermediate conduit 41. In this manner, a portion of the plating bath fluid is always circulating in a tributary stream interposed between the sample-removal conduit 4 and the transfer-conduit 42 so that the sample-transport conduit always receives the actual bath fluids. A pump means (not shown) can be operationally connected with the fluid-carrying conduits to maintain proper fluid flow. The recirculating tributary stream can be controlled via valve means 43. Thus, for example, when valve means 43 is closed, bath fluid flows through transport-conduit 42. The transport-conduit 42 can also be connected with conduit 46 via a valve means 44, which in preferred embodiments comprises a pneumatically actuated slide valve means, further details of which are fully described and claimed in co-pending application U.S. Ser. No. 124,360, filed Mar. 25, 1980, and which is incorporated herein by reference. Conduit 46 is connected at its other end with a container (not shown) having a calibration solution therein for calibrating the individual elements of the arrangement. With this type of system, transport-conduit 42 can be connected to either conduit 4 or 46 via slide means 44, which includes a plurality of apertures 44*a*, 44*b*, 44*c* selectively communicating with one another via slide member 45.

A valve means 7 is positioned to communicate with the outlet of valve means 44. Valve means 7 discontinuously removes a sample and is actuated by compressed air from a compressed air source 48. Further details of valve means 7 are fully set forth in the earlier referenced co-pending application Ser. No. 124,360, filed Mar. 25, 1980. The particular embodiment of such valve means here illustrated corresponds to FIG. 9 of such copending application functioning as a sample-taking valve means 7 in FIG. 2 of the present application. The individual connecting holes of valve means 7 are referenced *a* through *f* and are connectable with one another or, respectively amongst one another by corresponding grooves 7*a*, 7*b* and 7*c* provided in a slide member of such valve means. A precisely calibrated measuring loop 47 (calibrated to contain 1 ml, as indicated) is connected between holes *b* and *c* in the valve means 7. At the operative position illustrated at FIG. 2, conduit 4 is connected to hole *a* in valve means 7 via apertures 44*a* and 44*b* of valve means 44. From hole *a* the sample travels, via longitudinal groove 7*b* in the slide member of valve means 7, to the measuring loop 47 via connecting hole *b* and travels to the transport-conduit 42 via connecting hole *c*, longitudinal groove 7*c* and connecting hole *d*. The sample then continuous to flow in a corresponding manner through valve means 17 and 27 and finally back to the plating bath via conduit 4. In the slide position schematically illustrated, the piston-head 7*d* of valve means 7, which has a smaller diameter relative to the opposing piston-head 7*e*, is constantly charged or biased with compressed air from the compressed air source 48. When valve 44 is actuated for sample-taking, the compressed air from source 48 now also acts on piston-head 7*e*, which, as indicated above, has a relatively large diameter relative to that of piston-head 7*d*. Accordingly, the slide member, which is positioned in a slaving fashion between piston-heads 7*e* and 7*d*, is moved toward the right, relative to FIG. 2, so that the cross-wise extending groove 7*a* interconnects connecting holes *a* and *b* to one another and sample-taking for valve means 17 and 27 can occur without delay. At the operative position now under discussion, the longitudinal grooves 7*b* and 7*c* in the slide member now provide communication betwen connecting holes *b* and *e* and, respectively, between holes *c* and *f*. A metering syringe 50 is connected via conduit 52 with hole *f* and feeds a precisely metered amount of water, 20 mls as indicated, from a conduit 51 connected to a source of water (not shown) so that the contents in measuring loop 47 are forced to travel through conduit 9 and into a mixing container 8. In preferred embodiments, the metering syringe comprises a pneumatically-actuated metering syringe of the type described and claimed in co-pending U.S. Ser. No. 124,139 filed Feb. 25, 1980, which is incorporated herein by reference. The mixing container 8 is provided with a controllable discharge valve 53 and an electrically-powered magnetic stirring motor 54. A second metering syringe 55 (similar in construction and operation to metering syringe 50, earlier discussed) withdraws a portion of the sample in mixing container 8 via conduit 56 and feeds such portion to two measuring cells 10 and 11 of a colorimeter 12. An illumination source 57 is positioned to radiate light through cells 10 and 11 for impingement on a photo-cell 58 and in this manner the copper concentration in the sample can be determined in a per se known manner. As indicated by the double-headed arrows merging at valve 59, the sample in cells 10 and 11 can be either reintroduced into container 8 or can be sent to a collection container or disposal. The sample in cells 10 and 11 can also be repeatedly removed from the cells 10 and 11 and reintroduced therein.

Valve means 17 is positioned downstream from valve means 7 and in fluid communication with conduit 42. Valve means 17 is constructed and operates in a manner similar to that of valve means 7, except that a measuring loop 60 is connected between connecting holes *b* and *c* and is calibrated for 2 mls, as indicated. A metering syringe 61 (similar in construction and operation to metering syringe 50) is connected in fluid communication with valve means 7 as shown, so that during operation, the contents of measuring loop 60 can be transferred to mixing container 18 with distilled water fed to syringe 61 from a source (not shown) via conduit 62. The syringe 61 is calibrated for 20 mls per strokes, as shown. A pH electrode 22, which may be a silver/silver chloride electrode is positioned in container 18 and is connected to an electrical circuit (not shown) via lead 23. Container 18 is provided with a mixing means 64 and a pneumatically controlled discharge valve 63. A pneumatically actuated piston burette 20 (similar in construction and operation to metering syringes 50 and/or 61) is connected to the compressed air source 48 and, via conduit 65, is connected to a source of HCl (not shown) and via conduit 21, is connected to the interior of container 18. Upon actuation, the motorized piston burette 20 discontinuously adds 0.2 mls of the HCl solution to the bath sample in container 18 step-by-step until the end point of the titration is detected via electrode 22.

Valve means 27 is positioned downstream from valve means 17 and in fluid communication with conduit 42.

Valve means 27 is constructed and operates in a manner similar to that of valve means 7 and 17, except that a measuring loop 66 is connected between connecting holes *b* and *c* and is calibrated for 0.1 mls, as indicated. The actuation of valve means 27 occurs via a pneumatically controlled valve 67 in a manner corresponding to that of valves 49 or 71. A metering syringe 68 (similar in construction and operation to metering syringes 50 or 61 but calibrated to produce 45 mls of fluid per stroke) is positioned in communication with a water source (not shown) via conduit 28, with valve means 27 via conduit 28*a* and with a titration container 29 via conduit 28*b* so that upon actuation 0.1 mls of the plating bath sample are admixed with 45 mls of water and so-diluted sample is transferred to container 29. A second metering syringe 69 (similar in construction and operation to syringe 68, but calibrated for 15 mls) is connected to a source of NaOH (not shown) via conduit 30 and with container 29 via conduit 30*a* so that upon actuation a specific quantity, i.e., 15 mils, of sodium hydroxide solution is added to the container 29, which has to diluted bath sample therein. The container 29 is provided with a mixing means 31 and a controllable discharge valve 7 for insuring a uniform admixture of the solutions in the container and to discharge the titrated solution upon complete determination of the formaldehyde concentration. A third metering syringe 35 (similar in construction and operation to syringe 38 but calibrated for 10 mls) is connected to a source of $NH_2OH.HCl$ (not shown) via conduit 36 and to container 29 via conduit 36*a* so that upon activation, a step-wise addition of the titrating agent ($NH_2OH.HCl$) to container 29 occurs until the end point of the titration is achieved as determined by signals derived from the electrodes 32, 33 and 34 (which were earlier discussed in conjunction with the lower portion of FIG. 1).

Amperometric titration is utilized in the practice of the invention for formaldehyde determination vbecause this method is significantly more precise than other known titration methods.

Valve means 7, 17 and 27 are all penumatically controlled and are all connected to a common compressed air system or source 48. The metering syringes 50, 55, 61, 20, 68, 69 and 35 are also preferably pneumatically controlled and are all connected to the same compressed air source 48. The same is true of discharge valve 53, 63 and 70. Valves 49, 67 and 71 can also be pneumatically controlled and connected to the compressed air source 48. All of the various penumatically-actuated elements of the invention are operationally interconnected with the central control circuit 39 for timely actuation and operation.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalence may be resorted to, falling within the scope of the invention as claimed.

We claim as our invention:

1. In an apparatus for controlling the concentration of at least main consumable components of an electroless copper plating bath having main components comprised of an aqueous solution of copper ions, an aqueous solution of sodium hydroxide and an aqueous solution of formaldehyde, to predetermined relatively constant values, whereby copper ion concentration is colorimetrically identified and the sodium hydroxide and formaldehyde solution concentrations are titrimetrically identified and appropriate signals are sent to a source of such components to add a select amount of each component to said bath until the concentration of each component is at said predetermined relatively constant value, the improvement comprising wherein said apparatus comprises, in combination:

means for discontinuously taking a predetermined volume sample from said bath for each of said main components;

means for diluting each of said predetermined volume samples with a specific amount of water; and means for independently determining the copper ion concentration via colorimetry, the sodium hydroxide solution concentration via potentiometric titration and the formaldehyde solution concentration via amperometric titration.

2. In an apparatus as defined in claim 1 wherein said means for independently determining the sodium hydroxide solution concentration via potentiometric titration comprises a sensing means determining an end point of the titration, said end point being defined from the three greatest potential steps, given a constant titration agent addition, a step-wise controlled motorized piston burette means (20) adding contant volume units of a titration agent to the diluted sodium hydroxide solution, said burette means being deactivated for constant idle time periods after each individual titration agent addition to allow stabilization to occur in the titration solution before a signal is taken by said sensing means.

3. In an apparatus as defined in claim 1 wherein said means for independently determining the formaldehyde solution concentration via amperometric titration comprises:

means adding a predetermined amount of a standardized sodium hydroxide solution to said diluted bath sample;

means adding a standarized $NH_2OH.HCl$ titration solution in controlled step-wise constant volume units to said diluted bath sample; and a sensing means comprised of a working electrode, a referenced electrode and a counter-electrode, said electrodes being in contact with said diluted bath sample and in communication with an operational circuit, said working electrode comprising a gold electrode operating at a constant polarization voltage of 0–200 mV relative to said reference electrode, said circuit measuring the current between said work electrode and said counter-electrode.

4. In an apparatus as defined in claim 3 wherein said reference electrode is a silver/silver chloride electrode and said work electrode is operated at a polarization voltage of +50 mV.

5. In an appartus as defined in claim 3 wherein said means for independently determining the formaldehyde solution concentration via amperometric titration determines a final end point of amperometric titration by a point of intersection between two straight lines, a first of which extends parallel to the abscissa axis of a titration curve for formaldehyde and a titrating agent, and passes through a minimum of said titration curve and a second straight line is defined by a plurality of measured points on the quasi-linear area of the rising portion of said titration curve after the minimum thereof.

6. In an apparatus as defined in claim 5 wherein said first straight line is determined by identify the minimum of said titration curve and storing such information and said second straight line is determined by utilizing five measured points on the quasi-linear area of the rising portion of said titration curve and calculations of these straight lines occur according to a regression method and the point of intersection of said lines is determined via a computer means.

7. In an apparatus as defined in claim 1 wherein said means for discontinuously taking predetermined volume samples of said bath for each of said main components comprises:

three pneumatically-controlled slide valve means (7, 17, 27), each of said valve means being respectively connected to an individual predetermined volume measuring loop (47, 60, 66), said loops being positioned in a fluid flow path one behind the other in a series relation and a controllable valve (43) is positioned in a parallel relation relative to said series.

8. In an apparatus as defined in claim 7 wherein said measuring loops are connected in fluid communication with respective separate containers (8, 18, 29), each container being connected in fluid communication with respectively separate metering syringes (50, 61, 68) for addition of water to said container.

9. A method of automatically controlling the concentration of at least main components in an electroless copper plating bath having main components comprised of an aqueous solution of copper ions, an aqueous solution of sodium hydroxide and an aqueous solution of formaldehyde so that said concentration remains relatively constant throughout the operation of said bath, comprising the steps of:

discontinously withdrawing three separate samples from said bath, each sample being of a predetermined volume;

diluting each of said separate samples with a specific amount of water;

independently determining the concentration of each respective main component in a respective sample and generating a signal corresponding to such concentration; and adding a fresh amount of each main component to said bath in accordance with said signal.

10. A method as defined in claim 9 wherein said independent determination of the concentration of each respective main component comprises colorimetrically identifying the copper ion concentration, potentiometrically identifying the sodium hydroxide solution concentration and amperometrically identifying the formaldehyde solution concentration.

11. A method as defined in claim 10 wherein said potentiometric identification of the sodium hydroxide solution concentration comprises:

determining the end point of a titration of said diluted sodium hydroxide solution with a standardized hydrochloric acid solution by a) adding constant volume units of said hydrochloric acid solution to said diluted sodium hydroxide solution, b) admixing the resultant solution after each addition and providing a constant idle time after each such addition to stabilize the resultant solution, and c) obtaining a signal corresponding to the potential of said resultant solution after each such addition, repeating said steps (a) through (c) a plurality of time, noting the three largest potential signals so derived; and calculating the end point of said titration from the three largest potential signals via an approximative method known per se.

12. In a method as defined as in claim 10 wherein said amperometric identification of said formaldehyde solution concentration comprises:

determining a minimum point on a titration curve derived from step-wise constant volume additions of a standardized hydroxyl ammonium chloride ($NH_2OH.HCl$) solution to said diluted formaldehyde solution and generating a first straight line through said minimum point parallel to the abscissa axis of said curve;

measuring a plurality of points on said titration curve on a quasi-linear rising portion of said curve located after said minimum point thereof and generating a second straight line through said plurality of points so as to intersection said first straight line; and deriving a signal corresponding to the point of intersection between said first and second straight lines and calculating the concentration of formaldehyde solution from said intersection.

13. An apparatus for controlling the concentration of main components in an electroless copper plating bath having main components comprised of an acqueous solution of copper ions, an aqueous solution of sodium hydroxide and an aqueous solution of formaldehyde, comprising, in combination:

a first means connected to said copper plating bath for discontinuously withdrawing a defined separate sample from said bath for each of said main components;

a second means connected to said first means for diluting each said separate sample with a defined amount of water;

a colorimetric means connected to said second means for receiving a first of the diluted samples and generating a signal corresponding to the copper ion concentration in said first sample;

a potentiometric means connected to said second means for receiving a second of said diluted samples and generating a signal corresponding to the sodium hydroxide solution concentration in said second sample;

an amperometric means connected to said second means for receiving a third of said diluted samples and generating a signal corresponding to the formaldehyde solution concentration in said third sample;

a control means connected to each of said colorimetric means, potentiometric means and amperometric means for receiving signals therefrom and generating a control signal; and source means containing fresh solutions of each of said main components, said source means being connected with said control means for receiving said control signal therefrom and with said bath means for adding said fresh solutions in accordance with said control signal.

* * * * *